US005526724A

United States Patent [19]

Bruggeman

[11] Patent Number: 5,526,724

[45] Date of Patent: Jun. 18, 1996

[54] SCREW DRIVER WITH PALM KNOB

[76] Inventor: Homer F. Bruggeman, 3536 Rolling View Dr., White Bear Lake, Minn. 55110

[21] Appl. No.: 335,177

[22] Filed: Nov. 7, 1994

Related U.S. Application Data

[63] Continuation-in-part of Ser. No. 104,007, Aug. 10, 1993, abandoned.

[51] Int. Cl.[6] ..... B25G 1/00

[52] U.S. Cl. ..... 81/4.92; 81/177.4

[58] Field of Search ..... 81/177.4, 492

[56] References Cited

U.S. PATENT DOCUMENTS 371,225 10/1887 Stevens .
687,401 11/1901 Morse .
1,049,650 1/1913 Benjamin .
1,772,040 8/1930 Dunlea .
1,816,359 7/1931 Carlin .
4,093,008 6/1978 Martin .
5,052,253 10/1991 Lin .

*Primary Examiner*—James G. Smith
*Attorney, Agent, or Firm*—Burd, Bartz & Gutenkauf

[57] ABSTRACT

A tool having a palm knob that is joined to a handle with a connector. The connector allows the tool to be rotated without rotating the knob. The connector has a split head that fits into a countersunk recess to hold the knob in assembled relation with the handle. This allows the knob to be readily assembled on the handle without the use of any tools or additional structures. A washer coated with a friction resistant resin is located between the knob and the handle to laterally and longitudinally stabilize the knob relative to the end of the handle.

22 Claims, 6 Drawing Sheets

SCREW DRIVER WITH PALM KNOB

CROSS REFERENCE TO RELATED APPLICATION

This application is a continuation-in-part of U.S. application Ser. No. 08/104,007 filed Aug. 10, 1993 abandoned.

FIELD OF THE INVENTION

The invention relates to hand-held tools, particularly to a hand-held tool having a knob on the outer end of the handle thereof to allow the handle to rotate relative to the knob.

BACKGROUND OF THE INVENTION

During use of hand-held tools, such as a screw driver, it is necessary to apply torque or a rotating force as well as substantial axial force to insert or remove a threaded screw from a threaded bore. It is known to use an end portion rotatably mounted on the outer end of the handle of the screw driver so that the handle of the screw driver can be freely rotated relative to the knob while simultaneously applying axial force. For example, J. M. Dunlea in U.S. Pat. No. 1,772,040 issued Aug. 5, 1930, discloses a screw driver handle having a recess in the outer end thereof. A knob is located adjacent the outer end of the handle. The knob is attached to an inwardly directed stem having a head at the lower end thereof. The head cooperates with a sleeve located in the recess to rotatably mount and retain the head in assembled relation with the handle.

SUMMARY OF THE INVENTION

The invention is directed to a screw driver having a palm knob rotatably mounted and retained on the handle of the screw driver. The palm knob has a connector with split head portions located in a countersunk recess in the end of the screw driver handle. The split head portions allow the knob to be readily assembled on the handle without the use of any additional tools or structures. The connector holds the knob in assembled relation with the handle while allowing rotation of the handle as the knob remains stationary. This allows the screw driver to be used to apply torque together with an axial force on a screw without blistering or injury to the worker's palm.

The screw driver has a generally cylindrical handle that is secured to an elongated rod equipped with a tip for driving or removing screws. The handle has an end opposite to the rod. A recess is countersunk into the handle end. A tubular bore extends transversely into the handle end and connects the recess with the end of the handle. The tubular bore has a diameter that is less than the diameter of the recess. An end piece or knob is rotatably mounted on the end of the handle. A connector joined to the knob extends through the tubular bore and into the recess. The connector has a pair of lips that engage an annular shoulder surrounding the recess to hold the knob in assembled relation with the handle. The connector has a head that is separated into first and second head portions with a generally rectangular slot extending along the longitudinal axis of the head. The first and second head portions are moveable together to reduce the diameter of the head substantially the same as the diameter of the tubular bore when the head portions are moved into the bore. When the head portions are moved through the bore and into the recess, the head portions separate to their original positions to increase the diameter of the head greater than the diameter of the bore. This connects the knob to the handle end. The head portions each has a semi-conical outer surface to facilitate assembly of the knob on the handle end. A forward end portion of each head portion is generally parallel to the inner face of the knob whereby the inner face and forward end portions are rotatably engageable with the handle end and the bottom wall of the recess, respectively. The handle and rod freely rotate relative to the knob.

A modification of the screw driver has a generally cylindrical handle secured to an elongated rod. The handle has an end opposite the rod. A recess is countersunk into the end of the handle. A knob is rotatably mounted on the handle. The knob has a connector member that extends into the recess to hold the knob in assembled relation with the end of the handle. The connector includes a head that is divided into first and second head portions with a slot extending longitudinally through the connector. The recess has a first section and a second section joined to the first section. The first and second head portions are moveable together to reduce a diameter of the head as the head is moved through the first section of the recess. The head portions separate when the head is located in the second section of the recess. The first and second head portions each have a generally flat transverse forward end that rotatably engage a bottom surface adjacent the recess to limit inward movement of the knob for stability. A washer located between the knob and the end of the handle is rotatably engageable with the end of the handle to stabilize the knob on the handle end.

DESCRIPTION OF PREFERRED EMBODIMENTS

Figure 1:
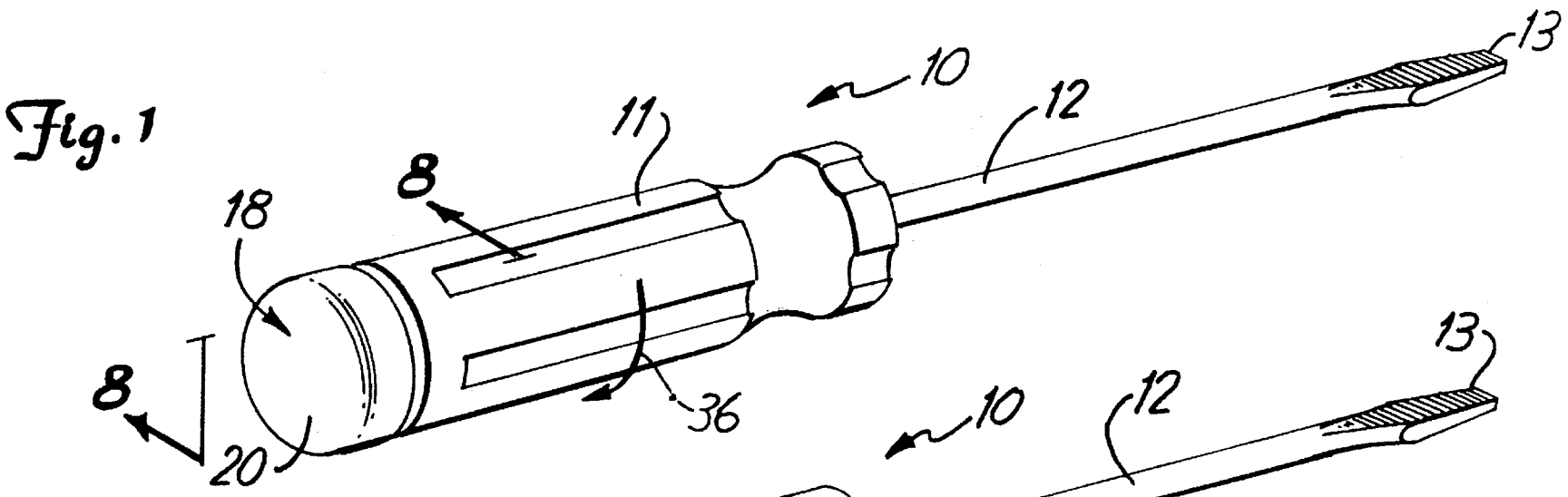
FIG. 1 is a perspective view of a screw driver having a palm knob.
Figure 2:
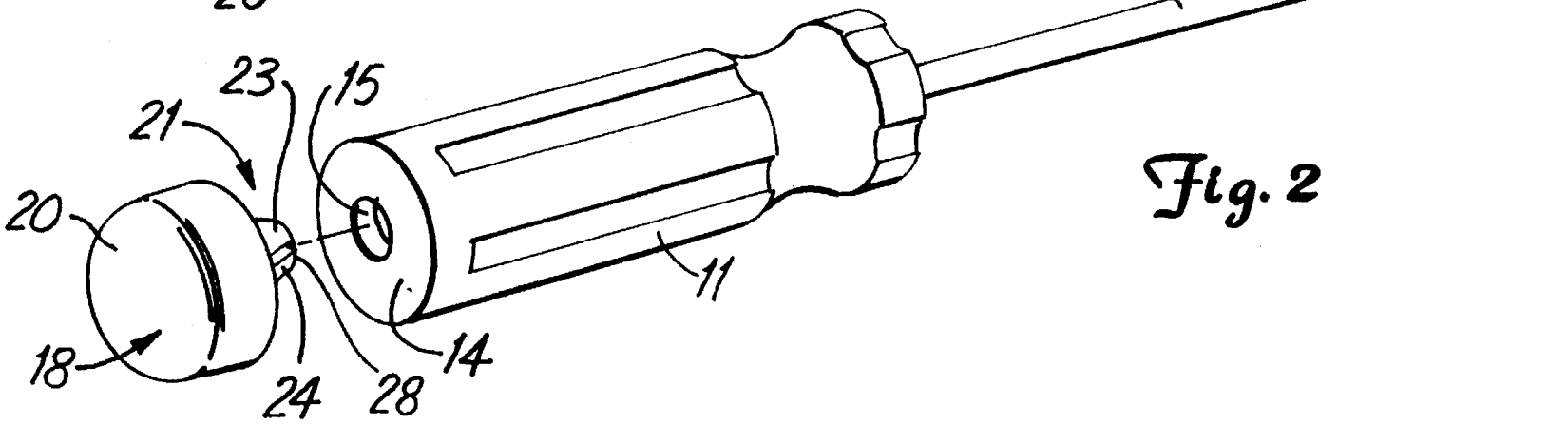
FIG. 2 is an exploded perspective view of the screw driver and palm knob of FIG. 1.

Referring to FIGS. 1 and 2, there is shown a screw driver indicated generally at 10. Screw driver 10 is primarily used to insert and remove a threaded screw into and from a threaded bore. Screw driver 10 is a hand held device that can be used to apply an axial force on the screw while simultaneously applying torque or a rotational force on the screw without rotation of an end piece or palm knob, indicated generally at 18, joined to the end of screw driver handle 11.

Figure 3:
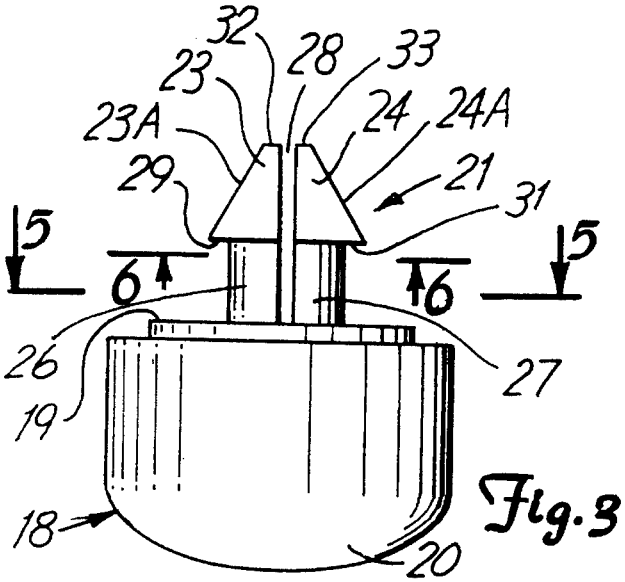
FIG. 3 is an enlarged side view of the palm knob.
Figure 4:
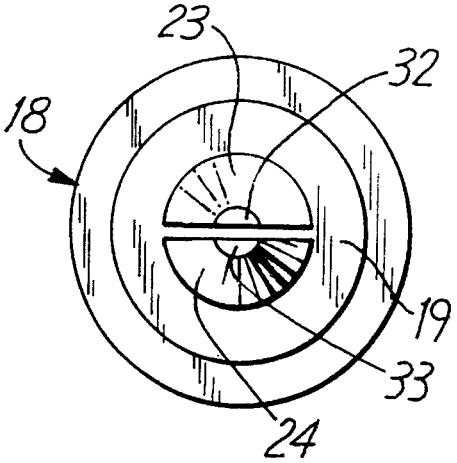
FIG. 4 is an inner end view of the palm knob.
Figure 5:
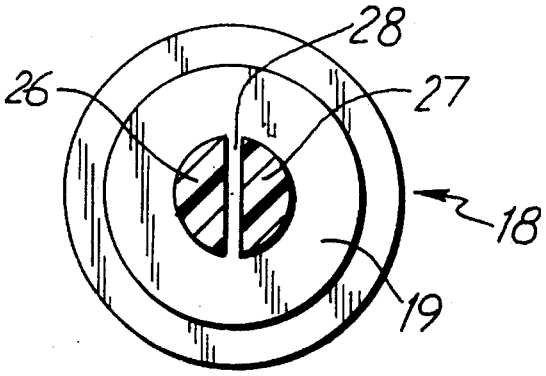
FIG. 5 is an enlarged sectional view taken along the line 5—5 of FIG. 3.
Figure 7:
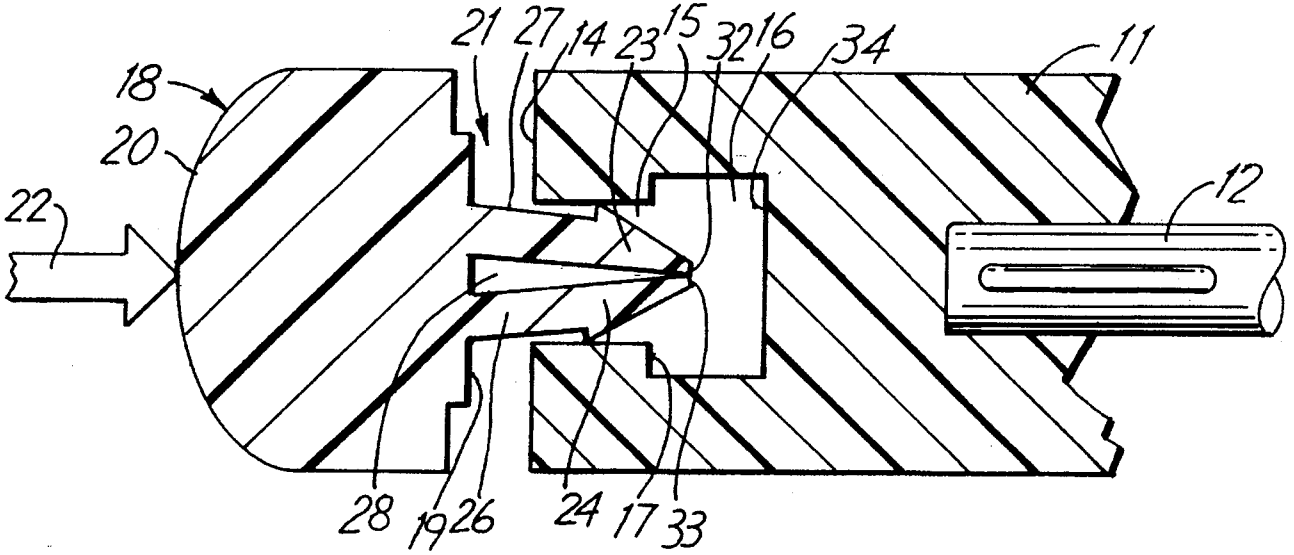
FIG. 7 is a longitudinal sectional view of the handle and knob showing the mounting of the knob on the handle of the screw driver.

Screw driver 10 has a generally cylindrical handle 11 connected to an enlongated driver blade or rod 12. Rod 12 has a rectangular end or tip 13 for driving slotted screws. Tip 13 can also be a cross-shaped tip to accommodated cross-slotted screws. The top of handle 11 has a flat end 14 having a centrally located bore 15 that is open to an enlarged cylindrical recess 16. As shown in FIG. 7, recess 16 has an inwardly directed annular shoulder 17 that surrounds bore 15. Shoulder 17 engages lips 29 and 31 of split heads 23 and 24 to retain knob 18 on handle 11. Referring to FIGS. 3 to 5, knob 18 has a generally flat inner face 19 and an outer convex surface 20 that fits into the palm of the worker's hand. A connector indicated generally at 21 secured to inner face 19 is used to rotatably connect knob 18 to handle 11 whereby the handle and rod 12 freely rotate relative to knob 18 as indicated by arrow 36 in FIG. 1, during operation of screw driver 10.

As shown in FIGS. 3 to 6, connector 21 has a generally rectangular slot 28 that extends longitudinally from inner face 19 of knob 18 to the outer end of connector 21 to define a pair of split heads 23 and 24. Slot 28 extends along the longitudinal axis of heads 23 and 24. Each head has a semi-conical outer surface 23A and 24A that converges inwardly toward a forward end 32 and 33. Elongated necks 26 and 27 secured to inner face 19 attach heads 23 and 24 to knob 18. As seen in FIG. 4, forward ends 32 and 33 have generally flat transverse surfaces that are parallel to inner face 19. Ends 32 and 33 and face 19 engage bottom wall 34 of recess 16 and handle end 14, respectively, when knob 18 is in an assembled relation on handle 11.

Figure 6:
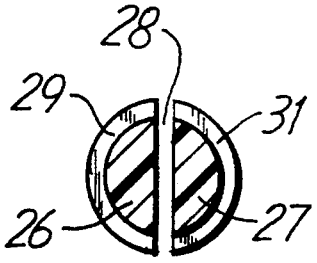
FIG. 6 is an enlarged sectional view taken along the line 6—6 of FIG. 3.
Figure 8:
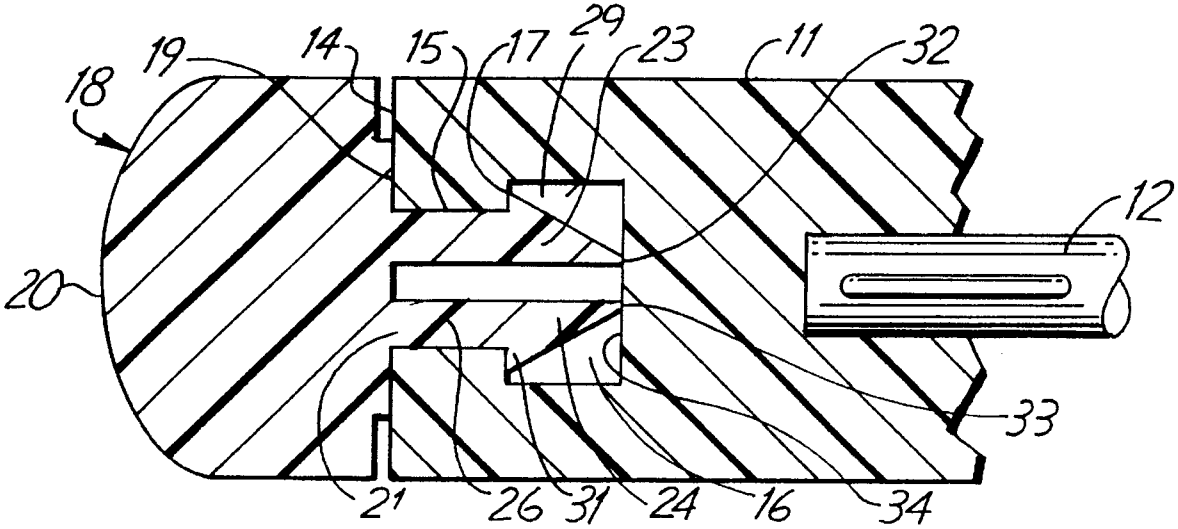
FIG. 8 is an enlarged sectional view taken along the line 8—8 of FIG. 1.

Referring to FIGS. 3 and 6, split heads 23 and 24 have outwardly projecting semicircular lips 29 and 31 that extend between necks 26 and 27 and semi-conical surfaces 23A and 24A. Lips 29 and 31 engage annular shoulder 17 surrounding bore 15 to retain heads 23 and 24 within recess and knob 18 on handle 11. As seen in FIG. 8, the outer edges of lips 29 and 31 are inwardly spaced from the side walls of recess 16 whereby the lips do not interfer with rotation of handle 11 relative to knob 18 and connector 21.

Connector 21 is preferably constructed with a semi-pliable plastic material. Other materials can be used to make connector 21. Connector 21 allows handle 11 and rod 12 to be rotated without rotation of knob 18. Since knob 18 remains stationary during rotation of handle 11 when driving screws, blistering and injury to the worker's hand palm is reduced.

To assemble screw driver 10, knob 18 is simply forced onto the end 14 of handle 11, as shown in FIG. 7. Connector 21 is aligned with and forced into bore 15, as indicated by arrow 22 in FIG. 7. Semi-conical surfaces 23A and 24A of heads 23 and 24 engage the outer edge of bore 15 as connector 21 is moved into the bore. Further inward movement of connector 21 into bore 15 causes the outer edge of bore 15 to ride up semi-conical surfaces 23A and 24A pinching split heads 23 and 24 together. As shown in FIG. 7, when heads 23 and 24 are fully within bore 15, forward ends 32 and 33 are forced together collapsing slot 28. Moving heads 23 and 24 into recess 16 allows the heads to separate and assume their original positions. Knob 18 is readily assembled on handle 11 without the use of any tools or additional structures.

Referring to FIG. 8, when knob 18 is connected to handle 11, forward ends 32 and 33 are located adjacent the bottom wall 34 of recess 16, inner face 19 of knob 18 is located adjacent flat end 14 of handle 11, and outwardly directed lips 29 and 31 of heads 23 and 24 engage annular shoulder 17 to hold knob 18 on handle end 14. Knob 18 is longitudinally stabilized knob 18 on end 14 preventing longitudinal movement of knob 18 relative to handle 11. Recess wall 34 and handle end 14 can be freely rotated relative to forward ends 32 and 33 and inner face 19, respectively. This enables the worker to simultaneously apply both an axial force and a rotational force on a screw with screw driver 10 without rotation of knob 18.

Referring to FIGS. 9 to 16, there is shown a modification of the screw driver of the invention, indicated generally at 100. Screw driver 100 is a hand held device that can be used to apply an axial force on a screw while simultaneously applying torque or a rotational force on the screw without rotation of an end piece or palm knob 118 joined to the end of handle 111 of screw driver 100. When driving screws, blistering and injury to the worker's hand is reduced.

Figure 15:
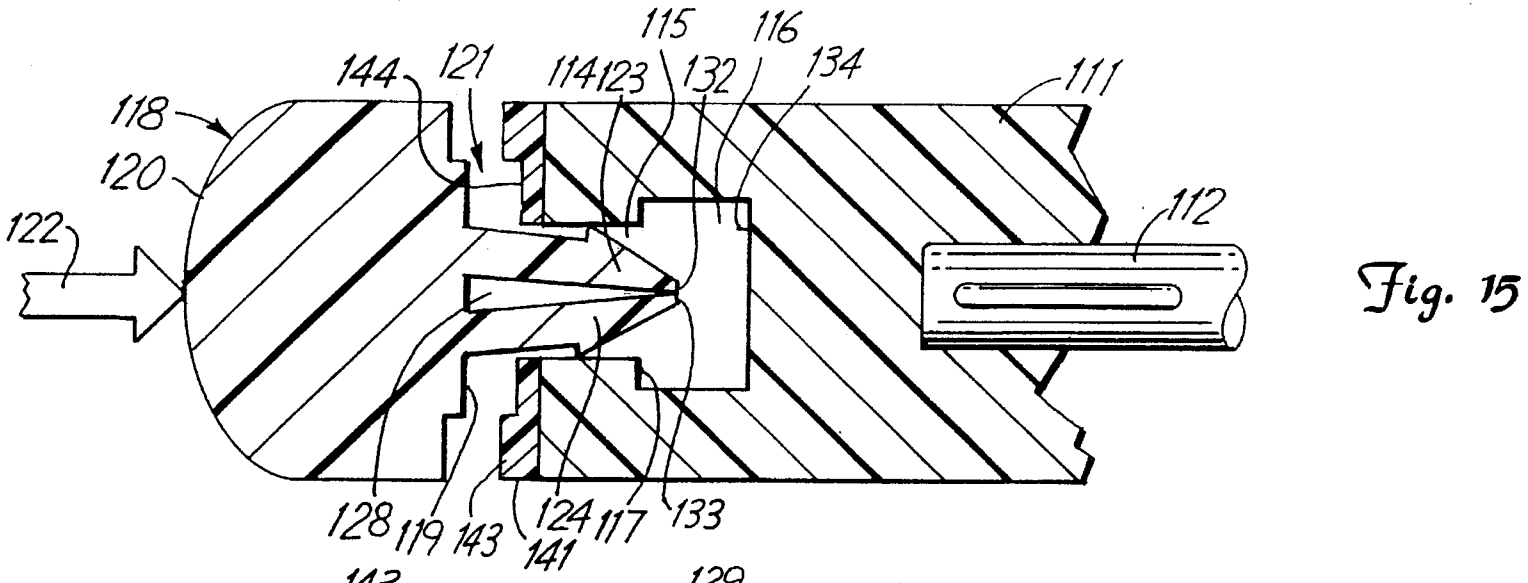
FIG. 15 is a longitudinal sectional view of the handle, washer and knob showing the mounting of the knob on the handle of the screw dirver.

Handle 111 is a generally cylindrical member that is connected to an elongated driver blade or rod 112. Rod 112 has a rectangular end or tip 113. Tip 113 can have other shapes, such as a cross shape. The top of handle 111 has a generally flat end 114 having a centrally located bore 115 open to an enlarged cylindrical recess 116. As shown in FIG. 15, recess 116 has an inwardly directed annular shoulder 117 that surrounds the inner end of bore 115. Shoulder 117 engages lips 129 and 131 of split heads 123 and 124 to retain knob 118 on handle 111.

Referring to FIGS. 11 to 14, knob 118 has a generally flat inner end face 119 and an outer convex surface 120. A connector 121 secured to a center portion of knob 118 is used to rotatably connect knob 118 to handle 111 whereby handle 111 and rod 112 can be freely rotated relative to knob 118, as indicated by arrow 136 in FIG. 9. Connector 121 has a generally cylindrical outer surface having a diameter that is substantially the same as the diameter of bore 115 whereby connector 121 is located in a sliding fit relation within bore 115. This functions to stabilize the rotation of knob 118 on handle end 114.

Figure 11:
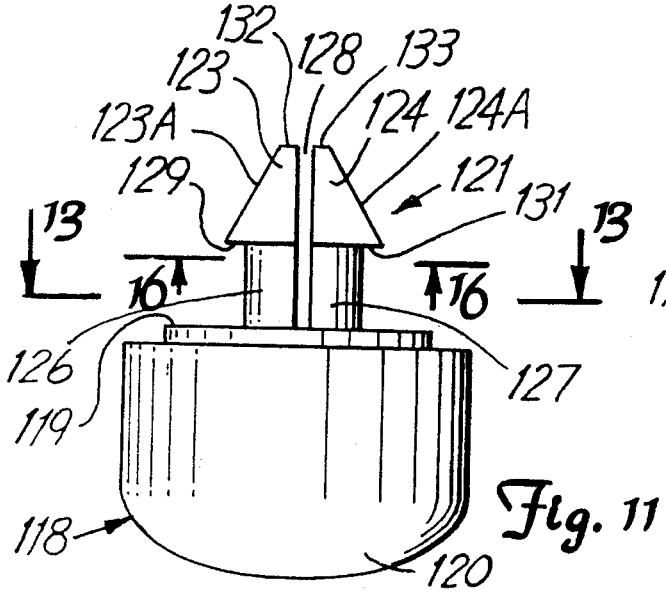
FIG. 11 is an enlarged side view of the palm knob.
Figure 12:
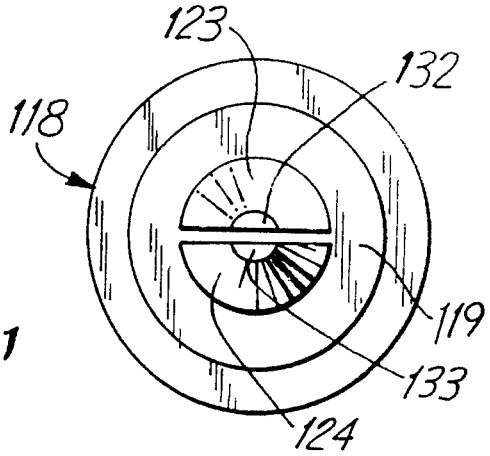
FIG. 12 is an inner end view of the palm knob.
Figure 13:
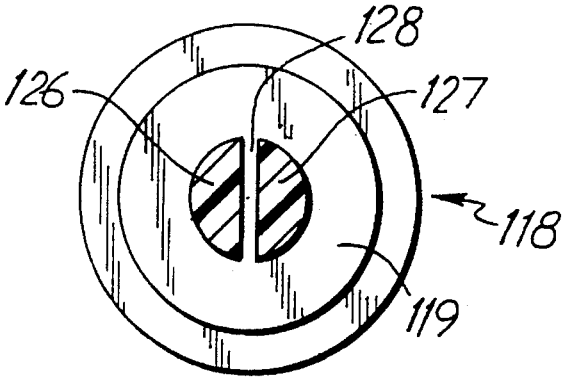
FIG. 13 is an enlarged sectional view taken along the line 13—13 of FIG. 11.
Figure 16:
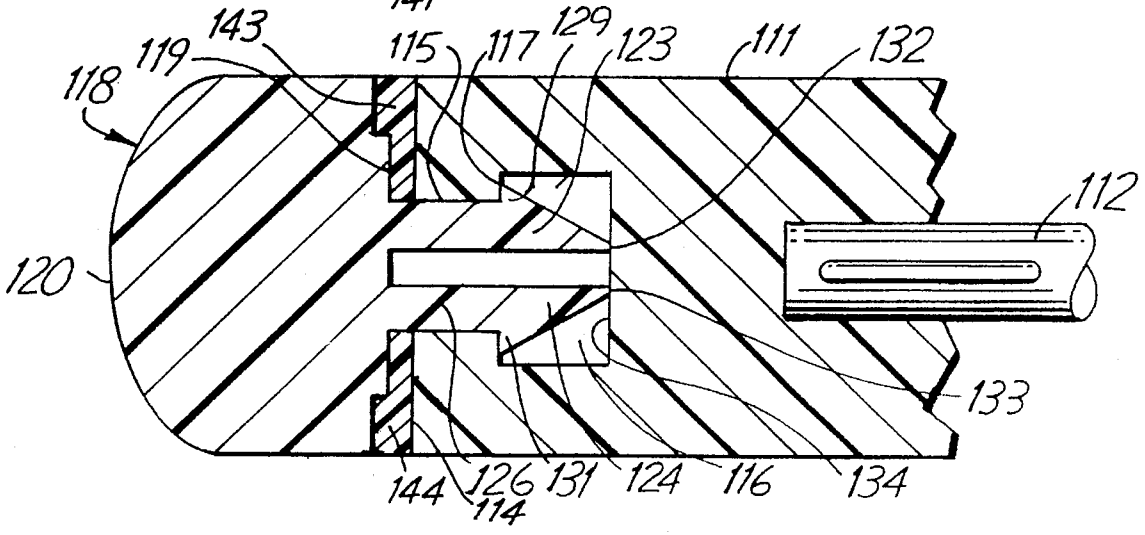
FIG. 16 is an enlarged sectional view taken along the line 16—16 of FIG. 9.

As shown in FIG. 13, inner face 119 of knob 118 has an annular peripheral groove. Inner face 119 extends normal to the central longitudinal axis of connector 121. Connector 121 has a generally rectangular slot 128 that extends longitudinally from inner face 119 to the outer end of connector 121 to define a pair of split heads 123 and 124. Connector 121 is preferably made from a semi-pliable plastic material. This allows heads 123 and 124 to be moved together to reduce a diameter of connector 121 as heads 123 and 124 are moved into bore 115. Heads 123 and 124 separate when moved through bore 115 into recess 116 as the diameter of recess 116 is greater than the diameter of bore 115. Each head 123, 124 has a semi-conical outer surface 123A, 124A that converges inwardly toward a forward end 132, 133. Elongated necks 126 and 127 secured to inner face 119 of knob 118 attach heads 123 and 124 to knob 118. As shown in FIGS. 11 and 12, forward ends 132 and 133 are generally flat transverse end surfaces that are longitudinally spaced and parallel to inner face 119. Ends 132 and 133 rotatably engage bottom wall 134 of recess 116 when knob 118 is in an assembled relation on handle, as seen in FIG. 16, to limit inward movement of knob 118 and stabilize knob 118 on handle end 114.

Figure 14:
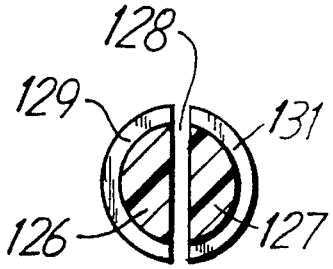
FIG. 14 is an enlarged sectional view taken along the line 14—14 of FIG. 11.

Referring to FIGS. 11 and 14, connector heads 123 and 124 have outwardly projecting lips 129 and 131 that extend between necks 126 and 127 and outer surfaces 123A and 124A of heads 123 and 124. Lips 129 and 131 are semi-circular transverse surfaces that engage annular shoulder 117 to retain connector 121 within recess 116 when knob is in an assembled relation on handle 111. As shown in FIG. 16, the outer edges of lips 129 and 131 are inwardly spaced from the side walls of recess 116 whereby lips 129 and 131 do no interfer with rotation of handle 111 relative to knob 118. Lips 129 and 131 engage shoulder 117 to prevent outward movement of knob 118 on end 114. This stabilizes rotation of handle 111 relative knob 118 and prevents longitudinal movement of knob 118 on handle 111.

Figures 9, 10:
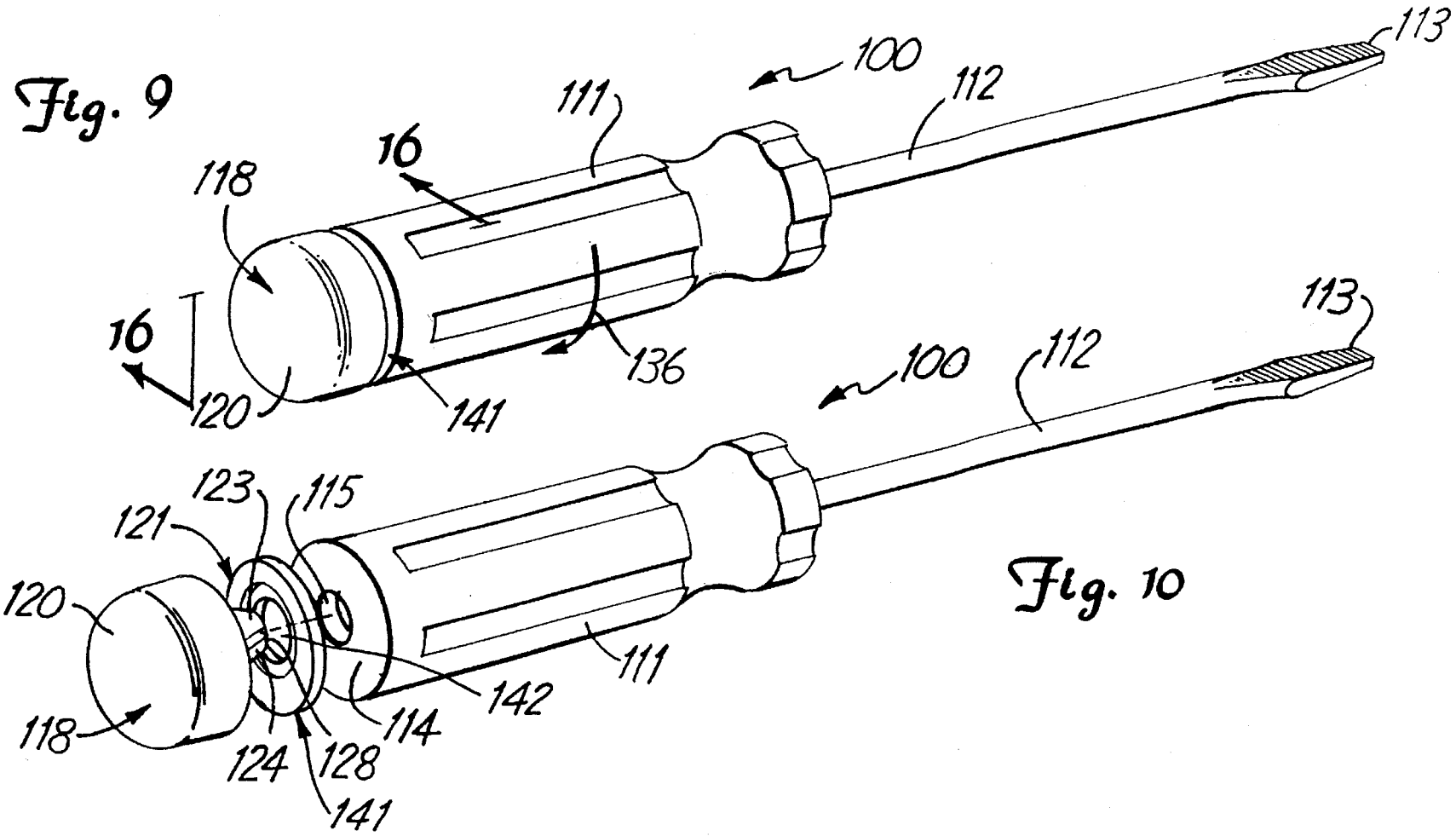
FIG. 9 is a perspective view of a modification of the screw driver having a palm knob and washer.
FIG. 10 is an exploded perspective view of the screw driver of FIG. 9.

Referring to FIGS. 10 and 15, a circular member or washer 141 is located between knob 118 and handle end 114. Washer 141 prevents side-to-side or wobbling movement of knob 118 thereby laterally stabilizing knob 118 relative to end 114. When knob 118 is connected to end 114, forward ends 132 and 133 of heads 123 and 124 engage recess wall 134 and washer 141 engages end 114 of handle 111 and inner face 119 of knob 118 to longitudinally and laterally stabilize knob 118 on handle 111. This prevents uneven rotation between knob 118 and handle 111 which facilitates the screw driving operation of screw driver 100.

Washer 141 is a circular member having a central opening 142. The diameter of opening 142 is generally the same as the diameter of bore 115 whereby washer 141 is located in sliding fit relation on necks 126 and 127 of connector 121. Washer 141 has a generally flat bottom surface located adjacent fiat end 114 of handle 111. The circumference of washer 141 is generally the same as the circumference of handle 111 whereby the outer sides of washer 141 are flush with the outer sides of handle 111. The top surface of washer 141 has a central recess 144 accommodating the center portion of inner face 119 of knob 118. Washer 141 has a peripheral annular shoulder 143 that fits into the annular groove in inner face 119 whereby knob 118, washer 141 and handle end 114 form a solid, stabilized assembly. Washer 141 is preferably made of a rigid material, such as metal, which is coated with a resin to facilitate rotation of handle 111. For example, a resin that can be used to coat washer 141 is TEFLON.

To assembly screw driver 100, knob 118 is forced through washer 141 and onto end 114 of handle 111. Connector 121 is aligned with and forced into opening 142 and bore 115, as indicated by arrow 122 in FIG. 15. Semi-conical surfaces 123A and 124A of connector heads 123 and 124 cause heads 123 and 124 to pinch together. When heads 123 and 124 are fully within bore 115, forward ends 132 and 133 are moved together collapsing slot 128. Moving heads 123 and 124 fully into recess 116 allows heads 123 and 124 to separate into their original positions, as seen in FIG. 16. Knob 118 is readily assembled on handle 111 without the use of any tools or additional structures, thereby reducing assembly costs.

Referring to FIG. 16, when knob 118 is assembled on handle 111, forward ends 132 and 133 are located in engagement with bottom wall 134 of recess 116. Lips 129 and 131 engage annular shoulder 117 to hold knob 118 on handle end 114. Connector necks 126 and 127 are located in sliding fit relation in bore 115. The bottom surface washer 141 rotatably engages end 114 of handle 111. Recess 144 in the top surface of washer 141 accommodates the center portion of inner face 119 of knob 118. Peripheral annular shoulder 143 of washer 141 fits into the annular groove in inner face 119. Knob 118 is stabilized on handle end 114 preventing longitudinal and lateral movement of knob 118 relative to handle 111. Handle 111 can be freely rotated relative to knob 118. This enables the worker to simultaneously apply both an axial force and a rotational force on a screw with screw driver 100 without rotation of knob 118 thereby preventing injury to the worker's hand. The sliding fit of connector necks 126 and 127 within handle bore 115 together with the rotatable engagement of the parallel surfaces of knob 118, washer 141 and handle 111 function to stabilize rotation and prevent longitudinal and lateral movement of knob 118 relative to handle 111 facilitating screw driving procedures.

While there has been shown and described preferred embodiments of the screw driver with palm knob according to the present invention, it is understood that changes in structure, materials and design can be made by persons skilled in the art without departing from the substance of the invention. The invention is defined in the following claims.

I claim:

1. A screw driver comprising: an elongated rod, a generally cylindrical handle secured to the elongated rod, the handle having an end opposite the rod, the end having a generally flat surface, a cylindrical recess means countersunk into the end of the handle, said handle having a bottom wall at the forward end of the recess, an inwardly directed annular shoulder at the rear end of the recess, and a bore open to a central portion of said flat surface and the recess means, said bore having a diameter less than the diameter of the recess means, knob means rotatably mounted on the handle, the knob means having an inner face with a center portion and an annular groove, connector means joined to the knob means extended through the bore into the recess means to hold the knob means in assembled relation with the end of the handle, the connector means including head means having a first head portion and second head portion, slot means separating the first head portion from the second head portion, the first and second head portions being movable together to reduce a diameter of the head means when the first and second head portions are moved into the bore and separable when the first and second head portions are moved through the bore into the recess means, the first and second head portions each having a generally flat forward end portion rotatably engageable with the bottom wall of the handle, the first and second head portions each having a rear portion rotatably engageable with the inwardly directed annular shoulder of the handle to retain the knob means on the handle, and washer means located between the knob means and the end of the handle, the washer means comprising a generally circular member having a top surface and a generally flat bottom surface, the top surface of the circular member having a central recess accommodating the center portion of the inner face of the knob means, and annular shoulder means located in the annular groove in the inner face of the knob means, the bottom surface of the circular member located adjacent to the flat surface on the end of the handle, the circular member rotatably engageable with the end of the handle to longitudinally and laterally stabilize the knob means on the end of the handle.

2. The screw driver of claim 1 wherein: the first and second head portions each has a semi-conical outer surface.

3. The screw driver of claim 1 wherein: the forward end portions and inner face of the knob means are generally parallel.

4. The screw driver of claim 1 wherein: the circular member has a circumference substantially the same as the circumference of the handle.

5. The screw driver of claim 1 wherein: the circular member has a center opening, the connector means including neck means having a generally cylindrical outer surface, the center opening having a diameter substantially the same as the diameter of the neck means.

6. The screw driver of claim 1 wherein: the rear portion of each head portion has at least one lip engageable with the inwardly directed annular shoulder.

7. The screwdriver of claim 1 wherein: the connector means includes neck means having a generally cylindrical outer surface, the outer surface slidably fitting into the bore to stabilize rotation of the knob means relative to the handle.

8. A screw driver comprising: a generally cylindrical handle secured to an elongated rod, the handle having an end opposite the rod, recess means countersunk into the end, a tubular bore extending transversely into the end and connecting the recess means with the end, knob means rotatably mounted on the end to allow the rod to be rotated without rotating the knob means, shoulder means adjacent the recess means, connector means secured to the knob means extendable through the tubular bore into the recess means, the connector means including lip means engageable with the shoulder means to hold the knob means in assembled relation with the handle, and washer means located between the knob means and the end of the handle, the washer means comprising a generally circular member having a center opening, a top surface and a generally flat bottom surface, the top surface having a central recess accommodating an inner portion of the knob means, annular shoulder means surrounding the central recess rotatably engageable with the knob means, the bottom surface located adjacent the end of the handle, the circular member rotatably engageable with end of the handle to stabilize the knob means relative to the end of the handle.

9. The screw driver of claim 9 wherein: the connector means includes head means having slot means forming a first head portion and second head portion, the first and second head portions moveable toward each other to reduce a diameter of the head means when the first and second head portions are moved through the center opening in the circular member into the bore and separable when the first and second head portions are moved through the bore into the recess means.

10. The screw driver of claim 9 wherein: the first and second head portions each having a generally flat transverse forward end portion rotatably engageable with a generally flat inner surface adjacent the recess means to stabilize the knob means on the end of the handle.

11. The screw driver of claim 9 wherein: the first and second head portions each has a semi-conical outer surface.

12. The screw driver of claim 8 wherein: the inner portion of the knob means has an annular side face and a generally flat inner face, the side face rotatably engageable with the annular shoulder means, the inner face rotatably engageable with the bottom of the central recess of the circular member.

13. The screw driver of claim 8 wherein: the bottom surface is rotatably engageable with the end of the handle.

14. The screw driver of claim 8 wherein: the circular member is coated with a friction resistant coating.

15. The screw driver of claim 8 wherein: the connector means includes neck means having a generally cylindrical outer surface, the outer surface slidably fitting through the center opening in the circular member and into the bore to stabilize rotation of the knob means relative to the handle.

16. A screw driver comprising: handle means secured to an elongated rod equipped with tip means, the handle means having recess means, the recess means having an inner section and an outer section open to an end of the handle means, knob means rotatably mounted on the end allowing the tip means to be rotated without rotating the knob means, a generally circular member having a center opening, a top surface and a generally flat bottom surface, the top surface having a central recesses accommodating the knob means, annular shoulder means surrounding the central recess rotatably engageable with the knob means, the bottom surface located adjacent the end of the handle, the circular member engageable with the end to stabilize the knob means relative to the end, and means secured to the knob means extendable through the center opening in the circular member and into the recess means to hold the knob means in assembled relation with the handle means.

17. The screw driver of claim 16 wherein: the means secured to the knob means includes lip means engageable with shoulder means adjacent the recess means to hold the knob means in assembled relation on the handle means.

18. The screw driver of claim 16 wherein: the means secured to the knob means has a first head portion and second head portion portion, each head portion having a generally flat forward end rotatably engageable with a generally flat inner surface adjacent the inner section of the recess means to stabilize the knob means on the end of the handle means.

19. The screw driver of claim 16 wherein: the knob means has an inner face with a center portion, annular groove means in the inner face adjacent the center portion, the central recess of the circular member accommodating the center portion of the knob means, the annular shoulder means located in the annular groove means in the knob means.

20. The screw driver of claim 16 wherein: the circular member has a circumference substantially the same as the circumference of the handle.

21. The screw driver of claim 16 wherein: the circular member is coated with a friction resistant coating.

22. The screw driver of claim 16 wherein: the means secured to the knob means includes neck means having a generally cylindrical outer surface, the outer surface slidably fitting through the center opening in the circular member into the outer section of the recess means to stabilize rotation of the knob means relative to the handle.

* * * * *